United States Patent [19]

Putz

[11] 4,182,970

[45] Jan. 8, 1980

[54] FILAMENT SHIELDS FOR PAR LAMPS

[75] Inventor: John M. Putz, Twinsburg, Ohio

[73] Assignee: General Electric Company, Schenectady, N.Y.

[21] Appl. No.: 886,878

[22] Filed: Mar. 15, 1978

[51] Int. Cl.[2] ..... H01J 5/16; H01J 61/40; H01K 1/26; H01K 1/30

[52] U.S. Cl. ..... 313/113; 313/41; 313/239; 313/240

[58] Field of Search ..... 313/39, 40, 41, 239, 313/240, 113, 117

[56] References Cited

U.S. PATENT DOCUMENTS

| | | | |
|---|---|---|---|
| Re. 29,390 | 9/1977 | Evers | 313/40 |
| 2,876,375 | 3/1959 | Marsh | 313/113 X |

*Primary Examiner*—Saxfield Chatmon, Jr.
*Attorney, Agent, or Firm*—Lawrence R. Kempton

[57] ABSTRACT

A filament shield for pressed glass reflector lamps is disclosed which comprises an iron base having an aluminum coating thereon heated to produce an $FeAl_3$ outer layer having a dark, matte finish.

3 Claims, 3 Drawing Figures

FILAMENT SHIELDS FOR PAR LAMPS

This invention relates to filament shields for PAR (parabolic aluminized reflector) lamps and, in particular, to a new material for such shields.

Filament shields are well known in the prior art as a means for controlling light: the light is, in theory, simply blocked from directly radiating through the lens ("Lens" is used in the generic sense well known in the art; namely, a glass cover for the reflector which may clear or fluted.) The remainder of the light from the filament is re-directed and controlled by the reflector. The result is a well controlled beam of light which, if desired, may be refracted by flutes in the lens to produce the desired beam pattern. In practice, there is some "spill light" due to the fact that the focus of a paraboloid is a point, whereas a filament is not a point source of light.

The beam pattern is only one of a plurality of considerations in making a lamp. Another is the life of the lamp, or more specifically, avoiding shortening the design life of the filament by extrinsic conditions. For example, low carbon steel has been used in the past for filament shields because of its low material cost, ease of fabrication and moderately low surface reflectivity. However, as known in the art, the interior of a lamp is analogous to a high temperature chemical factory due to the filament, which runs in excess of 2200° C. when the lamp is lighted. Whatever the behavior at lower temperatures, it is difficult to predict the behavior of materials within a lamp. Carbon steel shields for example are gassy, ie. absorbed gases are driven out when the lamp is lighted and can recombine in various ways. The contaminants thus produced, in turn, attack the filament and shorten the life of the lamp. Depending on the design life of the lamp, this poses a serious problem, eg. for lamps with a rated life in excess of 200 hours.

To minimize the contamination problem, a vapor deposited aluminum coating has been provided to enclose the shield. This increases costs and produces a highly reflective surface, increasing spill light.

In view of the foregoing, it is therefore an object of the present invention to provide a PAR lamp having an improved filament shield.

Another object of the present invention is to provide a PAR lamp having less spill light. The foregoing objects are achieved in the present invention wherein a filament shield is provided comprising aluminum clad steel in which the shield is heat treated to produce a dark, matte finish on the aluminum, thereby sealing the iron surface but without the reflectivity of vapor deposited aluminum.

A more complete understanding of the present invention can be obtained by considering the following detailed description in conjunction with the accompanying drawings, in which.

Figure 3:
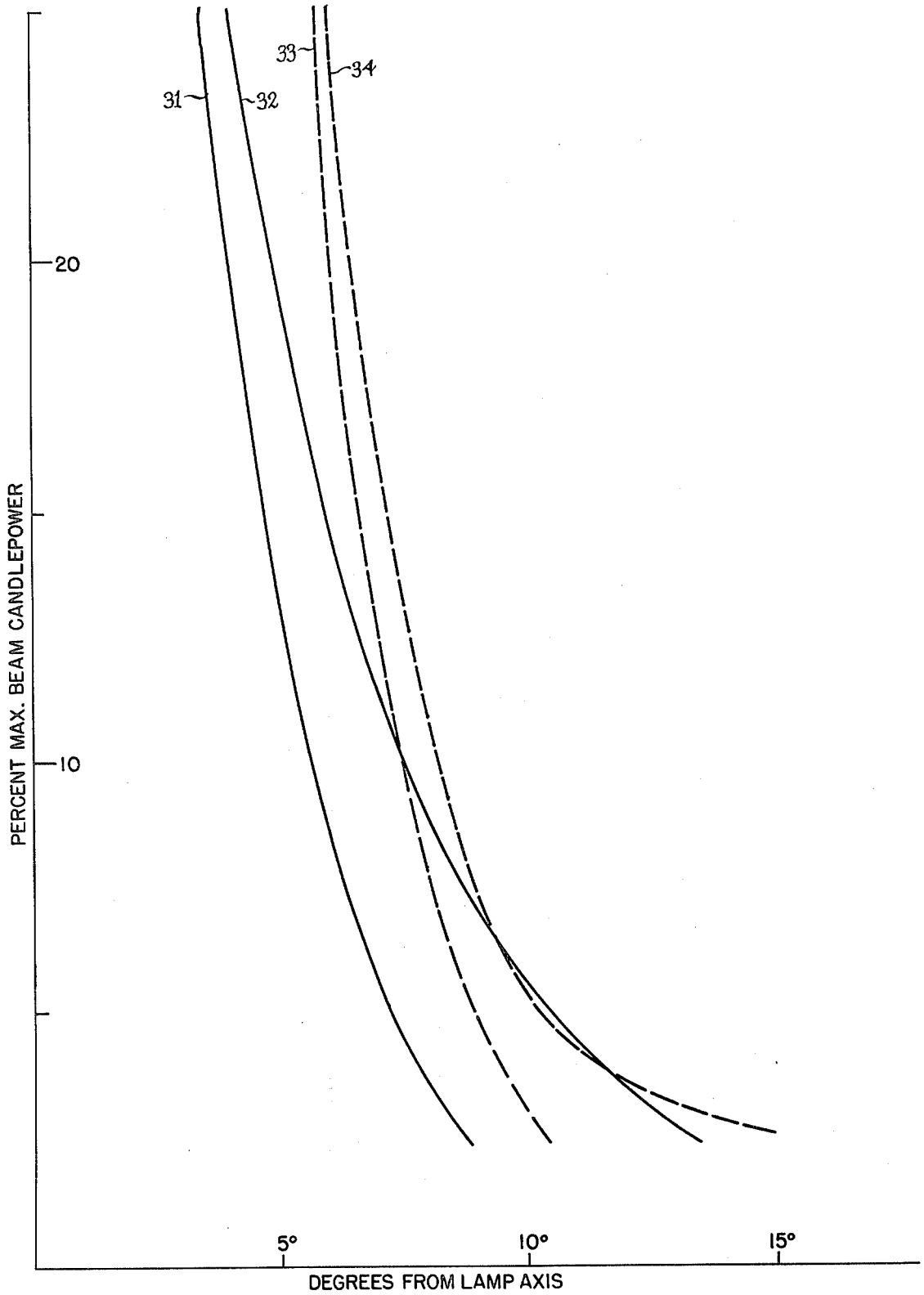

FIG. 3 comprises intensity distribution curves comparing the present invention with the prior art.

Figure 1:
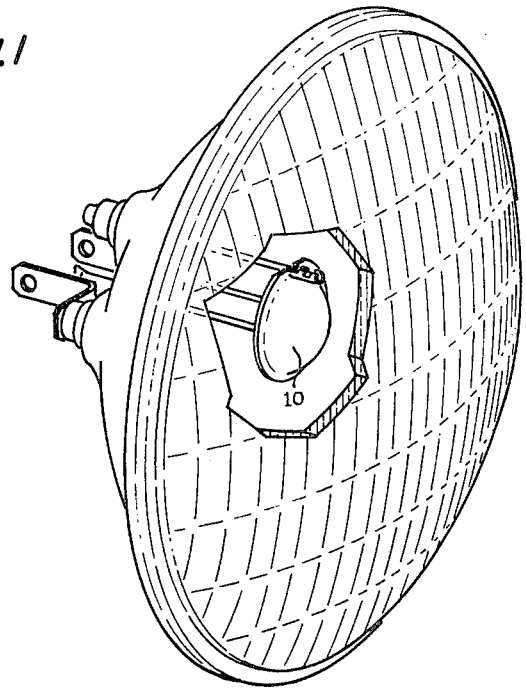
Fig. 1 PRIOR ART
FIG. 1 illustrates a PAR lamp in accordance with the prior art.
Figure 2:
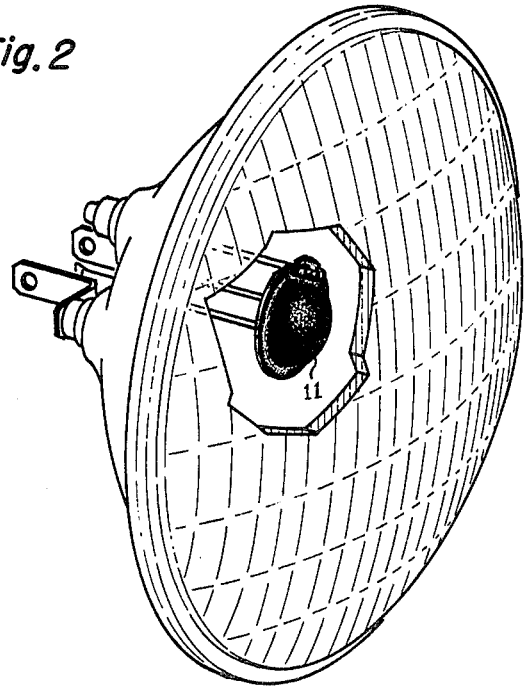
FIG. 2 illustrates a PAR lamp in accordance with the present invention.

FIG. 1 illustrates a PAR lamp in accordance with the prior art having an aluminum coated, steel filament shield 10 therein. In accordance with the present invention, as illustrated in FIG. 2, the PAR lamp has a shield 11 formed of aluminum-clad iron which has been heat treated to produce a dark, matte finish. Aluminum clad iron is commercially available, eg. under the tradename "Aliron" from Texas Instruments, Inc., Attleboro, Mass. In this material the aluminum coating not only seals the surface of the steel as in vapor deposited aluminum coatings, but further, upon heat treating, provides the added benefit of improved light control.

For example, as illustrated in FIG. 3 curve 31 illustrates the intensity distribution in the vertical plane of a 50 watt PAR 36 lamp in accordance with the present invention. Curve 32 illustrates the intensity distribution in the vertical plane of an otherwise identical lamp except that it has a vapor deposited aluminum coating on the filament shield. Similarly, curves 33 and 34 represent the intensity distribution in the horizontal plane of these same lamps, respectively. As can be seen from these curves the light control is improved in accordance with the present invention in addition to the prevention of contaminants from entering the lamp from the shield. The improved light control is immediately apparent upon viewing the beam patterns of the lamp directly on the screen. Lamps in accordance with the present invention have a noticably more definite cutoff off-axis as compared to lamps of prior art. While not to be construed as limiting, the following dimensions have been found to produce satisfactory filament shields in accordance with the present invention. A steel core having a thickness of from 5 to 30 mils and a coating on each side thereof of from 0.1 to 1.0 mils produces satisfactory shield. The heat treatment, which causes the dark, matte surface, may be performed in either air or hydrogen. For example, satisfactory surface characteristics are obtained by heating the shield to a temperature of 700° C. in air for approximately 10 minutes. A hydrogen or ammonia atmosphere and a temperature of up to 800° C. for approximately the same time also produces satisfactory surface characteristics.

The heat treatment appears to cause a chemical change in the material so that the shield, after treatment, may best be described as having an iron core with $FeAl_3$ on the outer surface.

There is thus provided by the present invention an improved shield for PAR lamps which, in combination with a PAR lamp, provides superior light control without causing deterioration of the life of the lamp. Having thus described the invention it will be obvious to those of skill in the art that various modifications can be made within the spirit and scope of the present invention. For example, various thicknesses and treatment times may be utilized other than those specifically enumerated above. Further, while shown in FIG. 2 as a solid shield, shield 11 may be provided with any desired aperture to enhance maximum beam candle power or other characteristic.

What I claim as new and desire to secure by United States Letters Patent is:

1. In a lamp having a reflector, a lens and at least one filament, the improvement comprising:

a filament shield interposed between said filament and said lens, said filament shield comprising an iron core having the surface thereof sealed by an $FeAl_3$ coating characterized by a dark, matte finish.

2. The lamp as set forth in claim 1 wherein said filament shield comprises an iron core from 5 to 30 mils thick covered by an $FeAl_3$ surface from 0.1 to 1.0 mils thick.

3. The lamp as set forth in claims 1 or 2 wherein said shield is predeterminedly positioned to block substantially all direct light going to said lens.

* * * * *